United States Patent [19]

Smith

[11] Patent Number: 4,773,115

[45] Date of Patent: Sep. 27, 1988

[54] SEWER CLEANING DEVICE

[75] Inventor: Robert C. Smith, St. John's, Canada

[73] Assignee: Systems Canada Limited, Canada

[21] Appl. No.: 916,365

[22] Filed: Oct. 7, 1986

[30] Foreign Application Priority Data

Oct. 8, 1985 [CA] Canada ..... 492476

[51] Int. Cl.[4] ..... B08B 9/02

[52] U.S. Cl. ..... 15/104.12; 15/104.31; 409/143; 409/307

[58] Field of Search ..... 15/104.09, 104.12, 104.13, 15/104.14, 104.3 R; 409/143, 307; 166/55; 51/245

[56] References Cited

U.S. PATENT DOCUMENTS

| | | | |
|---|---|---|---|
| 2,455,273 | 11/1948 | Schott et al. . | |
| 2,838,779 | 6/1958 | Craig et al. . | |
| 3,058,137 | 10/1962 | Doyle et al. | 15/104.12 X |
| 3,449,783 | 6/1969 | Kirschke . | |
| 3,525,112 | 8/1970 | Masters . | |
| 3,740,785 | 6/1973 | Latall | 15/104.12 |
| 4,084,484 | 4/1978 | Shklyanov et al. | 409/143 |
| 4,197,908 | 4/1980 | Davis | 409/143 |
| 4,337,096 | 6/1982 | Clifford . | |
| 4,475,260 | 10/1984 | Beck . | |
| 4,516,286 | 5/1985 | Crane | 15/104.12 |
| 4,577,388 | 3/1986 | Wood | 409/143 |
| 4,630,676 | 12/1986 | Long, Jr. | 409/143 X |
| 4,648,454 | 3/1987 | Yarnell | 409/143 X |

FOREIGN PATENT DOCUMENTS

| | | |
|---|---|---|
| 535382 | 1/1957 | Canada . |
| 887153 | 11/1971 | Canada . |
| 939459 | 1/1974 | Canada . |
| 1178005 | 11/1984 | Canada . |

*Primary Examiner*—Edward L. Roberts

*Attorney, Agent, or Firm*—Russell S. Smart; Ian Makinson; Karen M. Gerken

[57] ABSTRACT

Apparatus for removing obstructions from pipelines, such as sewers, comprises support means, motor means carried by the support means, cutter means adapted to be operated by the motor means, and means for locking the support means in a pipe, adjacent an obstruction whereby the apparatus may be locked in a predetermined position, and the motor means operated to drive the cutter means and remove the obstruction. The motor means may comprise an hydraulic motor. The cutter means may be a rotary saw. The means for locking the support means in position may comprise at least one hydraulic jack.

7 Claims, 6 Drawing Sheets

SEWER CLEANING DEVICE

This invention relates to remotely operable devices for cutting off protrusions in pipelines such as sanitary sewer lines.

Such devices are known in the art and generally comprise rotary knives or cutters, driven by a suitable motor such as an hydraulic motor, that are drawn through a sewer while the saw is driven by supplying fluid, usually water, under pressure to the hydraulic motor. While the prior art devices are to some extent effective, certain difficulties exist in operation. One of these difficulties is the tendency of the rotation of the cutter or saw blade to result in counter-rotation of the motor, with concurrent oscillation of the motor and saw blade in relation to the object being cut. Also, the effectiveness of these devices is limited by the diameter of the saw or cutter used, since these devices have a cutter with a diameter less than the internal diameter of the sewer pipe and tend to remain centrally disposed in the pipe in which they are operating. Thus, they do not remove all of a laterally projecting obstruction. These obstructions are known in the art as "laterals" and may comprise protruding house services, resulting from a domestic sewer pipe being improperly installed into the sanitary sewer system, projecting into the sewer system and thus creating an obstruction.

One of the ways of dealing with the problem of counter rotation of the driving unit in relation to the associated cutter is to manufacture the driving unit such that it has substantial mass, creating difficulties of size and of manipulation of the device in use.

The present invention seeks to overcome the disadvantages of the prior art discussed above, and other disadvantages, and to this end provides according to one aspect apparatus for removing obstructions from pipelines, such as sewers, comprising support means, motor means carried by the support means, cutter means adapted to be operated by the motor means; means for locking the support means in a pipe, adjacent an obstruction, and; means for advancing the cutter means relative to the support means, whereby the apparatus may be locked in a predetermined position, and the motor means operated to drive the cutter means forward and remove the obstruction. Preferably the motor means comprises a hydraulic motor, the cutter means is a rotary saw, and the means for locking the support means in position comprises at least one hydraulic jack.

According to another aspect of the invention, there is provided apparatus for removing obstructions from sewers, comprising; frame means adapted to be disposed in a sewer; a hydraulic motor carried by the frame means; a rotary cutter, rotatable by the motor, extending forwardly from the frame means; jack means on the frame means for locking the frame means in position in a sewer; means for moving the rotary cutter forward relative to the frame means; manifold means to which fluid under pressure may be supplied to operate the jack means and lock the frame in a predetermined position, rotate the motor, and operate the means for moving the rotary cutter to remove an obstruction in the path of the rotary cutter.

The apparatus is locked in place in a sewer, once fluid pressure is supplied to it, by the jacking means that act on one side of a sewer pipe to lock the support means in position. To this end, the support means, which preferably comprises a frame, may be provided with seating pins extending in a direction opposite to the direction of movement of the jacking means. Since, once hydraulic pressure is supplied to the device, it is locked in position, the hydraulic motor and its associated cutter can be operated without fear of counter rotation or concurrent oscillation of the frame means once the saw engages an obstruction. The motor and the cutter may be moved forward relative to the frame by, rearwardly directed jets that flow from orifices in a manifold secured to the hydraulic motor, and thus the motor and the cutter can be moved forwardly until the obstruction is removed.

While it is desirable, prior to using the above described device, to locate a specific obstruction, for example by a camera, and then to orient the device about the axis of the sewer pipe so that the cutter will remove a maximum amount of the protrusion, it is also possible to proceed through a pipe, towing the device by means of a suitable cable, commencing actuation of the above series of steps each time an obstruction is encountered. However, by specific identification of the location and the radial position of an obstruction, the precise placement of the device in the sewer pipe leads to the advantageous result that a protrusion can be cut off very close to the wall of the sewer into which it protrudes, thus not limiting the device to the removal of protrusions only within the radius of the cutter.

In the attached drawings, which illustrate an embodiment of the invention,

Figure 1:
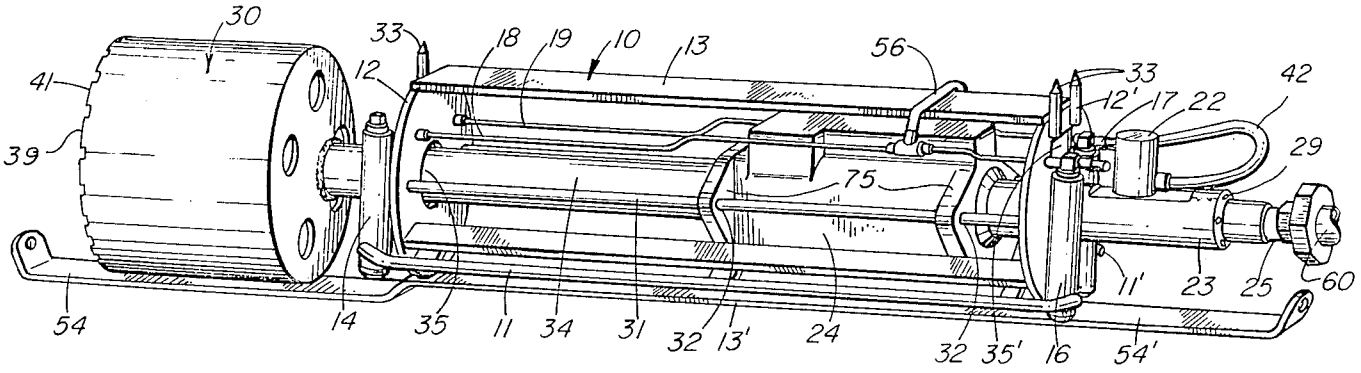
FIG. 1 is a perspective view of a sewer cleaning apparatus according to the invention.

In the drawings, 10 is a frame having skids 11, 11', with one skid being secured to each side of the frame. The frame comprises two more or less circular ends 12, 12' spaced apart by the skids 11, 11' and upper and lower longitudinal elements 13, 13'. Tow bars 54, 54' are provided so that the apparatus can be drawn through a sewer pipe in known fashion.

Secured to the frame at the front left corner, the front right corner, the left rear corner and the right rear corner are hydraulic jacks 14, 15, 16 and 17. These jacks are connected by fluid lines 18, 19, and 42 in pairs 14, 16 and 15, 17 to a pressure control valve 22 secured to the inlet manifold 23 for supplying fluid to the hydraulic motor 24.

The control valve 22 is in fluid communication with the interior of the manifold 23; further details of the operation of this valve will be set forth below.

At the rear of manifold 23 (FIG. 6) is a threaded connector 26 for a fluid line 60. Downstream of the connector 26 is a strainer 27 having a rearwardly extending removal pin 28, facilitating its removal and cleaning. Upstream of the strainer 27, and extending rearwardly, is a series of orifices 29, spaced evenly about the manifold 23, whereby fluid under pressure can be ejected in a rearward direction to propel the sub-assembly, comprising the manifold 23, the motor 24 and the saw 30, forwardly within the frame 10, in a manner to be clarified below.

Extending along each side of the frame 10 are guide rods 31, 31' that mate with openings 32 in flanges 75 secured to the body of the hydraulic motor 24. The openings 32 should be of a size sufficient to permit free sliding of the motor 24 along the guide rods 31, 31'.

Extending upwardly from the frame end 12, and the rear frame end 12', of the frame 10, are three stops 33 which will limit the upward movement of the frame 10 when the jacks 14 through 17 are actuated.

Output shaft 34 of the motor 24 extends forwardly through an opening 35 in frame end 12. The manifold 23 extends rearwardly through an enlarged opening 35 in rear end 12' of the frame 10.

Figure 2:
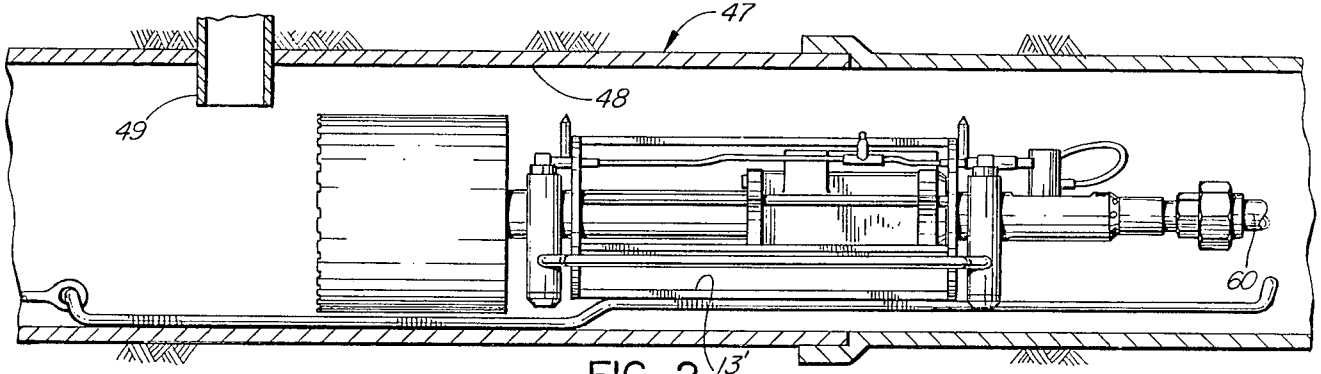
FIG. 2 is an illustration of the apparatus of FIG. 1, resting in a sewer pipe, the latter being shown in section.
Figure 3:
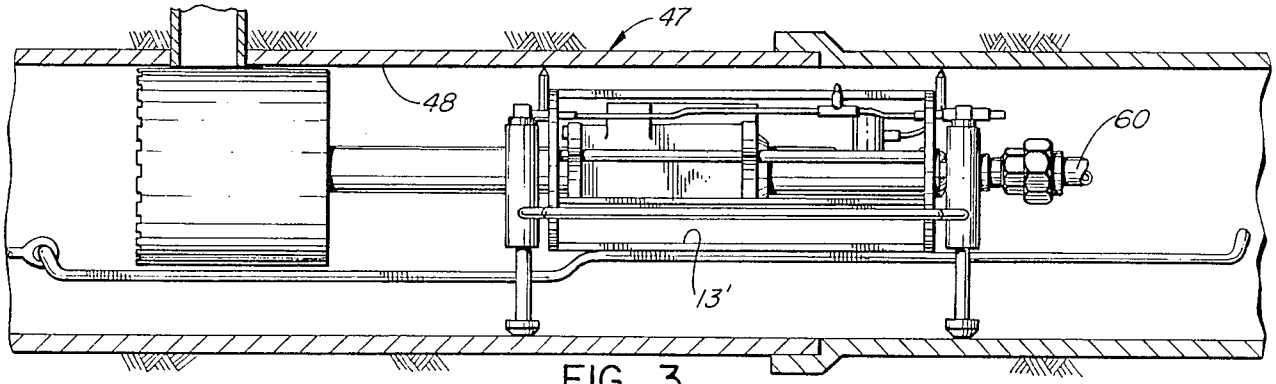
FIG. 3 is a view, similar to FIG. 2, showing the apparatus jacked into position just after cutting off a spur or lateral.

Turning now to the hydraulic circuitry of the device, reference has been made above to the manifold 23 and the fluid inlet comprising the threaded connector 26. The manifold 23 (FIG. 6) comprises a male threaded end 36 which can be screwed in sealing fashion into a mating female inlet at the rear of the hydraulic motor 24. When fluid under pressure at 100 psi is first applied to inlet 26, it proceeds to valve 22 via a restriction 22' at its base, then through conduit 42 to the jacks. After jacking time has been allowed, about 5 sec., full pressure of 900 psi is applied. At approximately 150 psi ball 38 unseats to maintain 150 psi in valve 22 so as not to overpressure the jacks. At approximately 200 psi, ball 37 of valve 63 unseats and remains unseated up through 900 psi, driving the hydraulic motor until the pressure is removed at 26. The frame is locked securely in position, as seen in FIG. 3, by the extended jacks 14–17 and locating pins 33. Before this is done, of course, the saw 30 will have been located as shown in FIG. 2 opposite and adjacent an obstruction 49 that it is desired to remove. The construction of the apparatus permits removal of long laterals.

Figure 4:
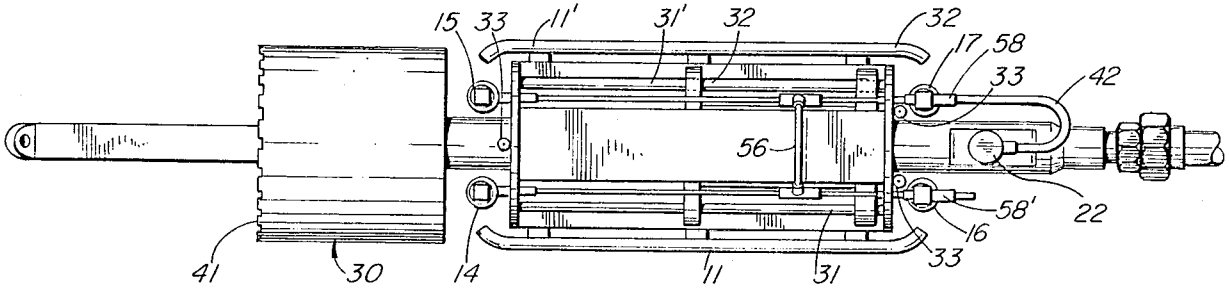
FIG. 4 is a plan view of the apparatus of FIG. 1.
Figure 6:
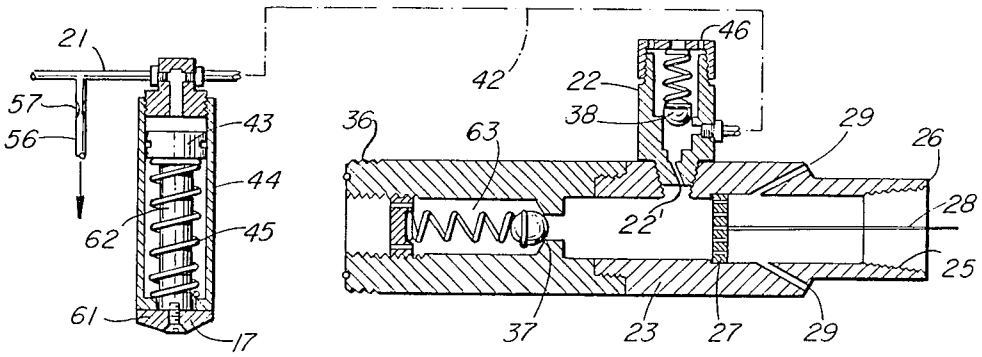
FIG. 6 is a detailed view of the control valve and jack.
Figure 5:
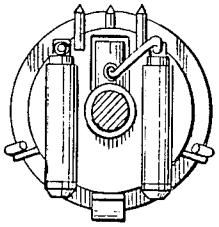
FIG. 5 is an end view, as seen from the right, of the apparatus of FIG. 1.

Referring now to FIGS. 4 and 6, the conduit 42 extending from valve 22 to the jacks is flexible. The line is shown in FIGS. 4 and 6 as extending from valve 22 to the right-hand rear jack 17. The fluid flows from the jack 17 through conduit 21 to the right front jack 15. A branch conduit 56 having a restriction 57 (FIG. 6) extends to the line 18 supplying the left hand jacks 14 and 16, so that when pressure is first applied to the apparatus as illustrated, the pressure will first be applied to the jacks 15 and 17. Thus, the apparatus can be forced, when viewed from the rear, to rise upwardly and to the left to assist the operator in locating the saw 30 adjacent a previously identified lateral. The restriction 57 slows the flow of fluid to the left-hand pair of jacks 14 and 16 leading to the above result. Before the apparatus is deployed in a pipe, the operator, having located a lateral, will switch the conduit 42 to a connection 58 or 58' on the right or left side of the apparatus. It will be appreciated by those skilled in the art that the presence of the lateral will first have been confirmed by passing a camera through the sewer. The connections 58 and 58' can be quick-connect couplings if desired.

Since the output shaft 34 is connected to the cutter or saw 30, the latter starts to rotate rapidly while the fluid emitted from the orifices 29 propels the manifold 23, the motor 24, and the saw 30 forwardly to engage with and cut off the obstruction 49 as shown in FIG. 3. The fluid pressure is then released and the device can be removed from the sewer so that the cycle of identifying and locating the obstruction, orienting and placing the device in position, and cutting off the obstruction can be repeated.

The saw 30 preferably comprises a cylindrical body 39 having a series of tungsten carbide cutters mounted is known fashion about the open cylindrical end 41, but any suitable saw can be used.

Due to the presence of the jacks and their utility in locking the frame in position, a relatively lightweight construction can be used. Using a commercially available motor such as the Char-Lynn (TM) model No. 101-1002, and by forming the frame from aluminum, it is possible to construct a unit having a total weight of less than 50 pounds, although the use of steel for the frame does not add appreciably to its weight. Further, the unit is of small size and can easily be manipulated into position opposite a sewer line opening and towed into position with a towing winch of the type normally used for towing a camera through a sewer line.

In hydraulic motors of the above described type, there is normally an outlet pipe (not shown) for fluid discharged when its work is done. By varying the size of this outlet pipe, provision can be made for the resulting thrust to assist in dragging the fluid supply hose through the sewer line. By decreasing the jet size and increasing fluid pressure, additional thrust is obtained without increased r.p.m. of the motor.

The jacks are of simple construction and comprise, in known manner, a piston 43 slidable in a cylinder 44 with a spring 45 biassing the piston 43 to the retracted or withdrawn position. A rod 62 secured to piston 43 is in turn secured to a foot 61. The central requirement for the jacks is that they be of simple construction capable of use in a sewer line without damage from corrosion, as will be obvious to those skilled in the art.

Figure 7:
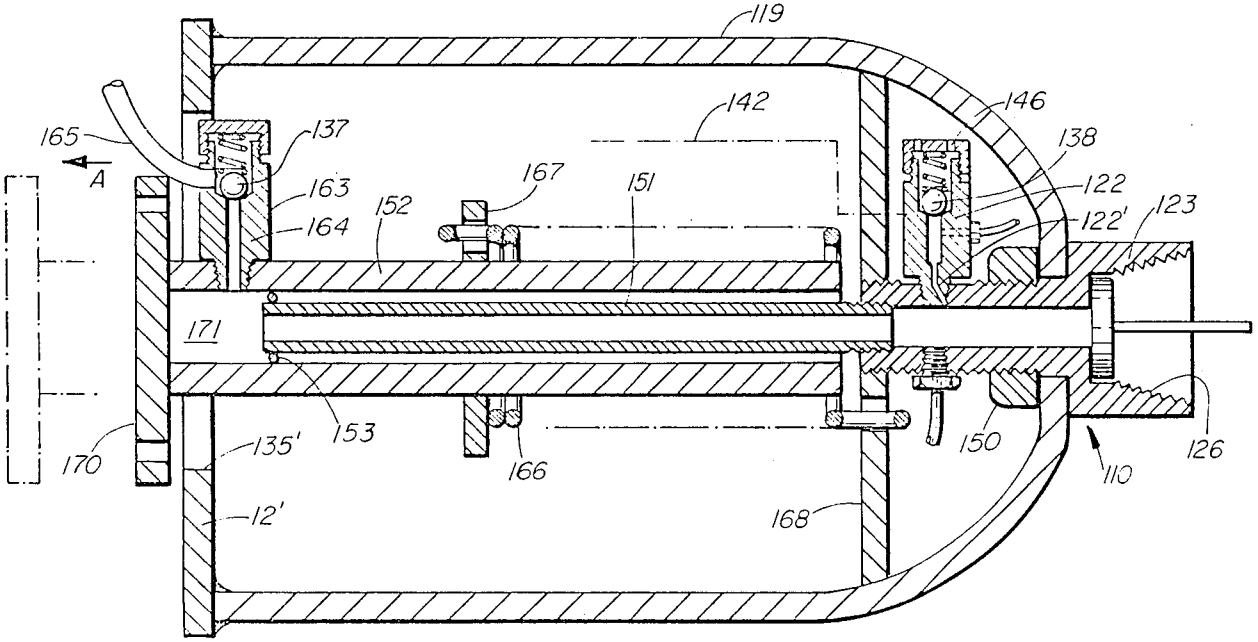
FIG. 7 is a partially sectional view showing a modification to the apparatus of FIG. 1.
Figure 8:
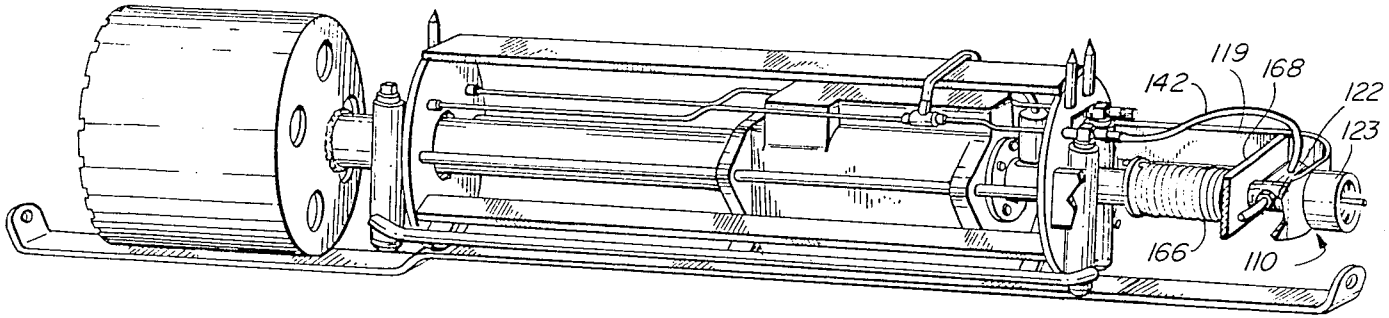
FIG. 8 is a perspective view of the modified apparatus.
Figure 9:
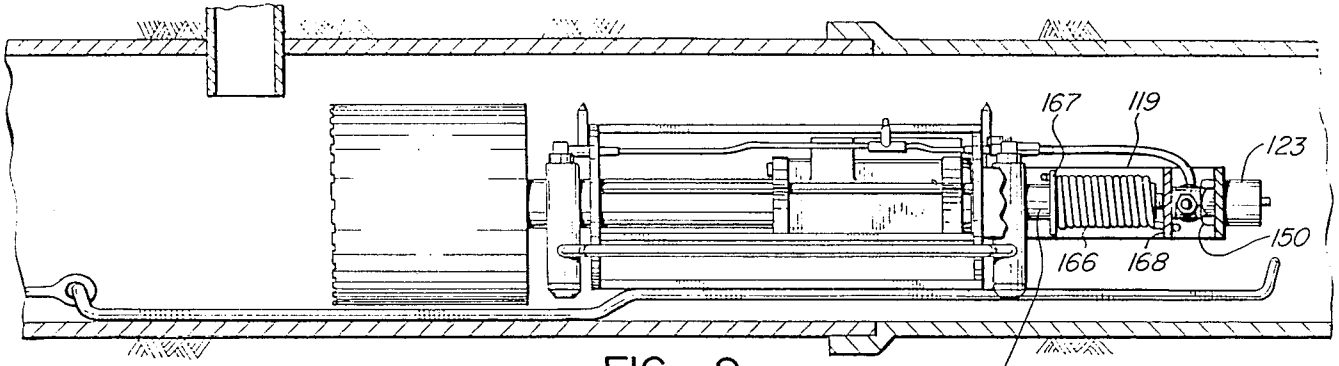
FIGS. 9 and 10 are views, similar to FIGS. 2 and 3, of the modified apparatus.
Figure 10:
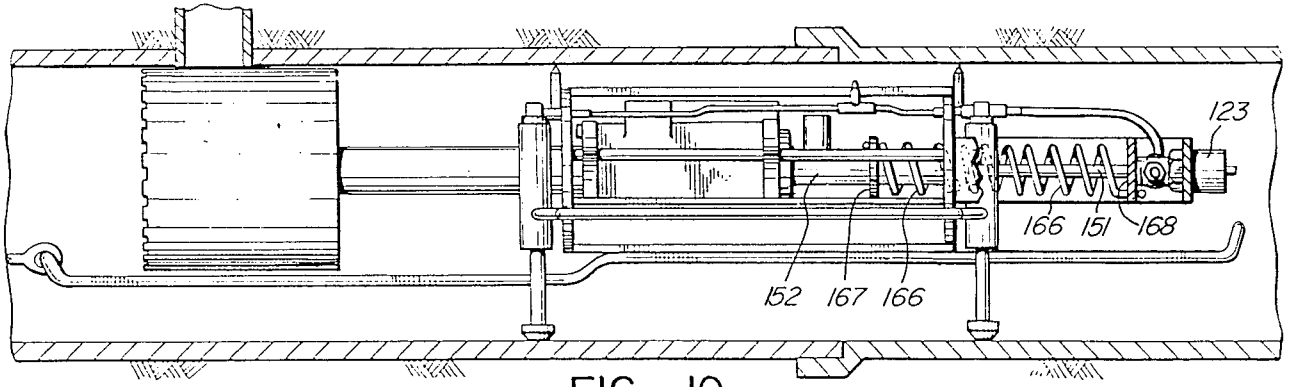

In some circumstances, the thrust provided by the jets from orifices 29 to propel the sawing device forward is not sufficient. For example, if the length of fluid supply hose 60 downstream of the apparatus is considerable, a substantial weight has to be moved as the saw 30 advances. To dispose of this problem, a construction such as the one illustrated in FIGS. 7–10 may be used. In FIG. 7, a sub-frame 119 is secured to the rear plate 12' of the frame 10 illustrated in FIG. 1, and an alternative means for moving the saw forward is provided. The apparatus of FIGS. 7–10 is otherwise generally the same as the apparatus of FIGS. 1–6.

It will be noted that a modified manifold 123 is secured by a nut 150 to the rear of the sub-frame 119 at 110. A hose connection 126 is provided, as in the embodiment of FIG. 1. Extending forwardly from the manifold 123 is a pipe or sleeve 151 that is telescopically received in a larger pipe or sleeve 152. An O ring 153 seals the inner sleeve 151 against the inside of the outer sleeve 152. The latter is secured to the motor by plate 170, e.g. by bolts (not shown). When fluid pressure is supplied to the apparatus through the inlet 126, the inner and outer sleeves 151 and 152 act as a piston and cylinder, and under the influence of the pressure within the system, positively force the motor 24, and thus the saw 30, forward. The hydraulic circuitry is otherwise generally the same in function as the circuitry described above with respect to the embodiment of FIG. 1. However, valve 163, unlike valve 63 of the first embodiment, is not coaxial with the inlet for fluid to the motor but instead is in a separate housing 164 threaded into sleeve 152. A conduit 165, dimensioned to ensure adequate flow of fluid, extends from downstream of the valve 163 to the motor. The ball 137 is set to open at approximately 200 psi as in the first embodiment. It will be appreciated that since the motor housing and its associated sleeve move independently of the fluid supply hose, the only weight that has to be moved by the hydraulic pressure is the weight of the motor, the saw and the pipe 152 and its associated valve 163.

A tension return spring 166 extends from collar 167 secured to sleeve 152 to frame element 168, and serves to return the sleeve 152 and thus the motor 24 and saw 30, to the position shown in FIG. 7 once pressure is released from the system. In the full extended position, i.e., after pressure has been supplied to move the sleeve 152, the motor 24 and the saw 30 to the left as shown by arrow A in FIG. 7, the parts will occupy the position shown in FIG. 10. Opening 135 in plate 112' is dimensioned to permit passage of the valve 163, sleeve 152, collar 167 and spring 166 as the latter elements are extended by application of fluid pressure through inlet 126.

In operation, fluid under pressure is supplied through inlet 126. It passes through restriction 122' as in the first embodiment and commences operation of the jacks 14–17. Once the pressure reaches 150 psi valve 138 unseats and excess pressure is exhausted through outlets 146. Due to the restriction 122, pressure builds up in chamber 171 defined by sleeves 151 and 152 causing movement of the sleeve 152 to the left; when the pressure reaches approximately 200 psi ball 137 is unseated to allow passage of the fluid through conduit 165 to the motor. At this point the saw 30 will start to rotate to cut an obstruction in the path of the saw, and the continued application of pressure will continue the movement of the sleeve 152 and thus removal of the obstruction.

Further modifications to the apparatus are possible within the scope of the invention. In some situations, for example, it may be desirable to remove encrusted material, such as calcite, from within a sewer. While the specific forms of the apparatus described above can achieve this objective only to a limited extent, by providing a rotary saw dimensioned to fit closely within a sewer pipe, and by securing the towing bar to a swivel secured to the saw at its axis of rotation, concurrently with suitable modification of the jacking system the apparatus can be used to remove the aforementioned calcite from within a sewer. The central problem addressed by the present invention is the positive locking of the motor support in position prior to operation of the motor, and forward movement of the saw; in addition to ensuring stability of the saw in operation, the positive support provided by the jacking means enables the saw teeth to attack an obstruction more positively thus solving the problems inherent in the prior art.

While an hydraulic motor has been described in the above, with suitable modification other power sources can be used, for example, a sealed electric motor could be used to operate the saw, and solenoids could be used to actuate the jacks and to cause the forward movement of the saw in relation to the frame.

The embodiments of the invention in which an exclusive property or privilege is claimed are defined as follows:

1. Apparatus for removing obstructions from pipelines, such as sewers, comprising:

(a) frame means;

(b) hydraulic motor means carried by said frame means;

(c) rotary saw means adapted to be operated by said motor means;

(d) a manifold attached to said motor means;

(e) rearwardly directed jets in said manifold for effecting axial sliding movement of said motor means and said saw means relative to said frame means;

(f) means for supplying fluid under pressure to said manifold; and (g) at least one hydraulic jack attached to said frame for locking said frame in a pipe, wherein said manifold is adapted to divide said fluid into flow paths for operating said motor means, said jack and said rearwardly directed jets in said manifold.

2. Apparatus for removing obstructions from pipelines, such as sewers, comprising:

(a) a frame means;

(b) hydraulic motor carried by said frame means;

(c) rotary saw means adapted to be operated by said motor;

(d) a manifold attached to said frame;

(e) cooperating piston and cylinder means between said motor and said manifold for effecting axial sliding movement of said motor and said saw means relative to said frame;

(f) means for supplying fluid under pressure to said manifold; and (g) at least one hydraulic jack attached to said frame for locking said frame in a pipe, wherein said manifold is adapted to divide said fluid into flow paths for operating said motor, said jack and said piston and cylinder means.

3. Apparatus for removing obstructions from pipelines, such as sewers, comprising:

(a) frame means;

(b) hydraulic motor means carried by said frame means;

(c) rotary saw means adapted to be operated by said motor means;

(d) a manifold attached to said motor means;

(e) means for supplying fluid under pressure to said manifold (f) a tubular element defining a piston extending forwardly from said manifold and a matching cylinder extending rearwardly from said motor, said tubular element being adapted to receive fluid under pressure for effecting axial sliding movement of said motor means and said saw means relative to said frame; and (g) at least one hydraulic jack attached to said frame for locking said frame in a pipe, wherein said manifold is adapted to divide said fluid into flow paths for operating said motor means, said jack and said piston and cylinder.

4. Apparatus for removing obstructions from sewers, comprising:

(a) frame means adapted to be disposed in a sewer;

(b) a hydraulic motor carried by said frame means;

(c) a rotary cutter, extending forwardly from said frame means, adapted to be rotated by said motor means and to slide forward with said motor means, relative to said frame means;

(d) means for moving said rotary cutter forward with respect to said frame means;

(e) jack means on said frame means for locking said frame means in position in a sewer;

(f) manifold means; and (g) orifices directed rearwardly from the interior of said manifold means to which fluid under pressure may be supplied to effect forward movement of said rotary cutter relative to said frame means, wherein said manifold means is adapted to supply fluid under pressure to operate said jack means and lock said frame in a predetermined position, to rotate said motor, and to operate said means for moving said rotary cutter, to thereby remove an obstruction in the path of said rotary cutter.

5. Apparatus for removing obstructions from sewers, comprising:

(a) frame means adapted to be disposed in a sewer;

(b) a hydraulic motor carried by said frame means;

(c) a rotary cutter, rotatable by said motor extending forwardly from the frame means;

(d) four jacks positioned on said corners of said frame means for locking said frame means in a position adjacent an obstruction in a sewer;

(e) means for moving said rotary cutter forward relative to said frame means;

(f) manifold means to which fluid under pressure may be supplied to operate said jacks, to rotate said motor, and to operate said means for moving said rotary cutter to remove the obstruction in the path of said rotary cutter; and (g) hydraulic lines extending from said manifold to said jacks, a restriction in one of said lines between a pair of said jacks on one side of said frame and a pair of said jacks on the other side of said frame, and means for supplying fluid to a selected pair of said jacks, whereby said restriction slows the flow of said fluid from one pair of said jacks to the other pair of said jacks and operates one pair before the other pair to tilt said frame while it is being jacked and thus locate said cutter in a desired position.

6. Apparatus for removing obstructions from sewers, comprising:

(a) frame means adapted to be disposed in a sewer;

(b) a hydraulic motor carried by said frame means;

(c) a rotary cutter, rotatable by said motor, extending forwardly from said frame means;

(d) jack means on said frame means for locking said frame means in position in a sewer;

(e) cooperating piston and cylinder means to effect forward movement of said rotary cutter and said hydraulic motor relative to said frame means;

(f) manifold means secured to said frame means at the rear thereof, to which fluid under pressure may be supplied to operate said jack means and lock said frame in a predetermined position, to rotate said motor, and to operate said piston and cylinder means for moving said rotary cutter to remove an obstruction in the path of said rotary cutter; and (g) control valve means for supplying a predetermined fluid pressure to said jack means before fluid is supplied to said motor.

7. The apparatus defined in claim 6 comprising second valve means that open after pressure is supplied to the jacks and permit the fluid to pass to the motor.

* * * * *